US009132337B2

(12) United States Patent
Batenburg, Jr.

(10) Patent No.: US 9,132,337 B2
(45) Date of Patent: Sep. 15, 2015

(54) IN-LINE SKATE BRAKING DEVICE

(71) Applicant: Richard M. Batenburg, Jr., Greenwood Village, CO (US)

(72) Inventor: Richard M. Batenburg, Jr., Greenwood Village, CO (US)

(73) Assignee: Batmann Consulting, Inc., Denver, CO (US)

( * ) Notice: Subject to any disclaimer, the term of this patent is extended or adjusted under 35 U.S.C. 154(b) by 0 days.

(21) Appl. No.: 14/208,980

(22) Filed: Mar. 13, 2014

(65) Prior Publication Data

US 2014/0265177 A1 Sep. 18, 2014

Related U.S. Application Data

(60) Provisional application No. 61/780,181, filed on Mar. 13, 2013.

(51) Int. Cl.

| | |
|---|---|
| ***A63C 17/14*** | (2006.01) |
| ***A63C 17/00*** | (2006.01) |
| ***A63C 17/24*** | (2006.01) |

(52) U.S. Cl.

CPC ..... *A63C 17/004* (2013.01); *A63C 17/1445* (2013.01); *A63C 17/24* (2013.01)

(58) Field of Classification Search

CPC .... A63C 17/004; A63C 17/008; A63C 17/06; A63C 17/24; A63C 17/1409

USPC ..... 280/11.204, 11.206, 11.211, 11.217

See application file for complete search history.

(56) References Cited

U.S. PATENT DOCUMENTS

| | | | | |
|---|---|---|---|---|
| 1,811,532 | A * | 6/1931 | Benetatos | 280/843 |
| 5,143,387 | A | 9/1992 | Colla | |
| 5,171,032 | A | 12/1992 | Dettmer | |
| 5,375,859 | A | 12/1994 | Peck et al. | |
| 5,439,238 | A | 8/1995 | Neal | |
| 5,551,711 | A | 9/1996 | Mangelsdorf | |
| 5,551,712 | A | 9/1996 | Repucci | |
| 5,716,074 | A | 2/1998 | Theodorou | |
| 5,829,756 | A | 11/1998 | Mitchell et al. | |
| 5,967,552 | A * | 10/1999 | Roderick et al. | 280/843 |
| 5,992,862 | A | 11/1999 | Mitchell | |
| 6,012,725 | A | 1/2000 | Mitchell et al. | |
| 6,116,621 | A | 9/2000 | Flater | |
| 6,254,109 | B1 | 7/2001 | Horton | |
| 6,279,921 | B2 | 8/2001 | Bozinovic | |
| 6,279,922 | B1 | 8/2001 | Gaster | |

(Continued)

FOREIGN PATENT DOCUMENTS

| | | |
|---|---|---|
| CA | 2064517 | 12/1992 |
| CA | 2107312 | 3/1995 |

(Continued)

OTHER PUBLICATIONS

International Search Report and Written Opinion for International (PCT) Patent Application No. PCT/US2014/025914, mailed Jul. 18, 2014.

*Primary Examiner* — Hau Phan
*Assistant Examiner* — Bryan Evans
(74) *Attorney, Agent, or Firm* — Sheridan Ross P.C.

(57) ABSTRACT

A braking device is provided for an in-line skate where the braking device selectively alters the motion of the in-line skate depending upon the angulation of the in-line skate relative to a surface. As a user angulates or tilts the in-line skate, the braking device increasingly engages the surface to provide a braking force to alter the motion of the in-line skate.

14 Claims, 13 Drawing Sheets

(56) References Cited

U.S. PATENT DOCUMENTS

| | | | | |
|---|---|---|---|---|
| 6,478,312 | B1 | 11/2002 | Petrucci et al. | |
| 6,729,628 | B2 | 5/2004 | Bellehumeur et al. | |
| 6,905,127 | B2 * | 6/2005 | Lester | 280/11.28 |
| 6,948,723 | B1 | 9/2005 | Bellehumeur et al. | |
| 2001/0054804 | A1 | 12/2001 | Lovitt et al. | |
| 2003/0146586 | A1 | 8/2003 | Hurwitz | |
| 2004/0207163 | A1 | 10/2004 | Smyler et al. | |
| 2005/0035563 | A1 | 2/2005 | Krivulin | |
| 2006/0097465 | A1 | 5/2006 | Lansel | |
| 2007/0170017 | A1 | 7/2007 | Brandriff et al. | |
| 2008/0029979 | A1 | 2/2008 | Chang | |

FOREIGN PATENT DOCUMENTS

| | | |
|---|---|---|
| CA | 2122526 | 10/1995 |
| CA | 2318075 | 7/1999 |
| CA | 2472518 | 1/2005 |
| CA | 2550827 | 12/2007 |
| DE | 19800891 | 1/1998 |
| DE | 19932425 | 1/2001 |
| DE | 20012979 | 8/2001 |
| DE | 20216903 | 3/2003 |
| DE | 202005000254 | 4/2005 |
| DE | 202006001203 | 4/2006 |
| DE | 102006034082 | 11/2007 |
| EP | 0744198 | 11/1996 |
| WO | WO 92/05845 | 4/1992 |
| WO | WO 98/35732 | 8/1998 |
| WO | WO 98/45003 | 10/1998 |
| WO | WO 99/36142 | 7/1999 |
| WO | WO 2006/042003 | 4/2006 |
| WO | WO 2007/070401 | 6/2007 |
| WO | WO 2008/082675 | 7/2008 |
| WO | WO 2009/101308 | 8/2009 |

* cited by examiner

IN-LINE SKATE BRAKING DEVICE

CROSS REFERENCE TO RELATED APPLICATIONS

This application claims the benefit of U.S. Provisional Patent Application No. 61/780,181, filed Mar. 13, 2013, which is incorporated by reference in its entirety.

FIELD OF THE INVENTION

Embodiments of the present invention are generally related to a braking device used to selectively alter the speed of an individual wearing in-line skates.

BACKGROUND OF THE INVENTION

In-line skates comprise boot portion for receipt of the user's foot. A wheel frame, which supports at least two tandem wheels, is interconnected to a lower surface of the boot. In-line skates have become popular recreational equipment and are often used as an alternative to roller skates. Furthermore, in-line skates are preferred by floor or roller hockey enthusiasts who seek an ice hockey experience. However, many players find it difficult to slow and stop in the same manner and fashion as experienced in ice skating when wearing in-line skates.

Most in-line skates employ a brake pad on the aft end of the frame and/or boot. To stop, the user tilts his or her toe upwardly, which rotates the boot about the rearmost wheel and places the brake pad in contact with the ground. As one of skill in the art will appreciate, pad-to-ground contact generates a friction load that slows and eventually stops forward motion. Brake pads work well to stop forward motion, but cannot slow or stop a user when his or her boots are moving laterally, i.e., when attempting to make a turning stop often performed while playing ice hockey, or participating in other in-line skate activities. Further, using such brakes is awkward as the user must shift his or her body weight rearwardly in such a way to place the pad in contact with the ground. Over-rotation will cause the user to fall, which could cause serious injury.

To address this latter issue, some in-line skates employ handbrakes similar to those used in bicycles that comprise a pad that contacts a portion of at least one wheel of the in-line skate. For example, U.S. Published Patent Application No. 2004/0207163 to Smyler discloses a handbrake that contacts a rear wheel to reduce the forward velocity. The system is unusable for floor or roller hockey players because they require both hands to hold a hockey stick.

Other in-line skates employ disc brakes as disclosed in WIPO Publication No. 2008/082675 to Lin, which discloses a device that includes a mechanism that interconnects above the user's ankle wherein the user must tilt rearwardly to actuate the brake. These devices suffer the same drawbacks of over-rotation and potential injury described above. Still other in-line skates include a toe-actuated brake as disclosed in U.S. Pat. No. 5,143,387 to Colla. These braking devices add complexity and cost to the in-line skate and are not intuitive to use, especially to those who are accustomed to slowing or stopping as they do when using ice skates.

It is a long felt need to provide an in-line skate braking device that allows for ease of braking while not adding complexity to the in-line skate or by requiring the user to use his or her hands. The following disclosure describes an improved braking device that allows the user to slow and stop while turning as commonly performed by ice hockey players, and to make in-line skating safer and more enjoyable for other enthusiasts.

SUMMARY OF THE INVENTION

It is one aspect of embodiments of the present invention to provide an in-line skate braking device that generates braking force dependant on degree of lateral tilt or change in orientation. This aspect of the present invention is desirable to individuals who play floor hockey, roller hockey, or participate other in-line skate activities because braking force is not dependent on the distance between the skate heel or tip and the ground.

It is thus another aspect of embodiments of the present invention to provide an in-line skate brake that allows the in-line skate to slow or stop much like an ice skate wherein the amount of ice skate lateral deflection dictates the applied braking force. Braking while laterally tilting the in-line skate more accurately simulates ice-skating where the degree of turn dictates the generated force that impedes forward motion of the skate and the user. Thus, individuals playing floor hockey, roller hockey, or participating in other in-line skate activities will have a more realistic experience. Individuals who play ice hockey can use the in-line skate and braking apparatus as contemplated herein for training purposes and not have to adjust their normal play to account for alternative braking methods employed by existing in-line skates. In addition, the realistic slowing and stopping options provided to all users will increase user safety and enjoyment.

It is an aspect of embodiments of the present invention to provide a braking force that increases as a user progressively engages a braking device. More specifically, the braking device of one embodiment comprises a housing or receiver interconnected to a brake frame that accommodates a plurality of spring-loaded balls that selectively contact the ground when the in-line skate is tilted laterally a predetermined amount. The amount of skate tilt will dictate the normal force the ball applies to the ground and, thus, the applied frictional braking force. The ball may rotate within the housing or fixed relative thereto.

It is yet another aspect of the present invention to provide braking device that includes replaceable elements. To provide maximum braking force, some embodiments of the present invention employ a ball that rotates to some degree which will cause it to wear over time. When the ball, or other friction-producing member, wears, it can be quickly and easily replaced by removing a retainer that secures the components of the braking device to the slider receiver. Further, if a user desires to upgrade components of the present invention or replace worn-out parts, the parts may be easily replaced.

It is yet another aspect of some embodiments of the present invention to provide a fully adjustable braking device to suit different user preferences and skill levels. Adjustable aspects of the braking device include, but are not limited to, modification of the angle of the braking device from a vertical plane, the distance that the braking device extends from the frame or in-line skate, and whether the brake force responds linearly, non-linearly, or otherwise from the user's input, i.e., tilting of the braking device into a surface. Further, a user may arrange the braking devices in various configurations. In some embodiments, the braking devices are arrayed on either side of an in-line skate frame. Alternative embodiments may allow a user to selectively remove and replace braking devices such that one side of the in-line skate has one or more braking devices, and the other side may have no braking devices.

It is one aspect of embodiments of the present invention to provide an in-line skate assembly, comprising: a frame having a plurality of receivers each having a proximate end and a distal end; a spring cap positioned in each of the plurality of receivers at the proximate end of each receiver; a sliding collar positioned in each of the plurality of receivers, wherein an outwardly extending flange is disposed on a proximate surface on each of the sliding collars, and wherein a distal surface on each of the sliding collars includes an aperture; a ball positioned in each of the sliding collars, wherein at least a portion of the ball is exposed through the aperture on each of the sliding collars; a locator disk positioned within each of the sliding collars and located on a side of the ball opposite the aperture on each of the sliding collars; a spring positioned in each of the plurality of receivers, the spring having a first end and a second end, wherein the first end of the spring interfaces with each the spring cap, wherein the spring extends into the sliding collar, and wherein the second end of the spring interfaces with the locator disk such that the spring exerts a force on the locator disk, which in turn exerts a frictional force on the ball, which biases a portion the ball against the distal surface of the sliding collar; a retainer with an inwardly extending flange on a distal surface of the retainer, wherein the retainer operatively interconnects to each of the plurality of receivers; wherein each of the sliding collars has a first position of use wherein the inwardly extending flange of the retainer is selectively engaged with the outward extending flange of the sliding collar; and wherein each of the sliding collars has a second position of use wherein the ball is in contact with a surface and the ball is forced into each of the plurality of receivers.

It is still yet another aspect of embodiments of the present invention to provide a braking device for interconnection to an in-line skate, comprising: a slider receiver having an inner diameter, a proximate end, and a distal end; a slider partially disposed in the slider receiver, the slider having an outer diameter that is less than the inner diameter of the slider receiver; a ball partially disposed in the slider, the ball having a diameter that is less than the outer diameter of the slider; and a biasing device having a first end and a second end, wherein the first end of the biasing device interfaces with the proximate end of the slider receiver, and wherein the second end of the biasing device is operatively interconnected with the ball.

It is a further aspect of embodiments of the present invention to provide an in-line skate assembly, comprising: a frame having a plurality of receivers having a proximate end and a distal end, the distal end of each of the plurality of receivers having an inwardly facing flange that forms an aperture; a first friction-generating means disposed in each of the plurality of receivers at the distal end of the receivers, wherein at least a portion of the first friction-generating means is exposed through the aperture of the inwardly facing flange of each of the plurality of receivers; and a biasing means disposed between the proximate end of each of the plurality of receivers and the first friction-generating means of each of the plurality of receivers, wherein the biasing means produces a force against the first friction-generating means of each of the plurality of receivers.

The Summary of the Invention is neither intended nor should it be construed as representing the full extent and scope of the present invention. Moreover, references made herein to "the present invention" or aspects thereof should be understood to mean certain embodiments of the present invention and should not be construed as limiting all embodiments to a particular description. The present invention is set forth in various levels of detail in the Summary of the Invention and in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken with the drawings.

BRIEF DESCRIPTION OF THE DRAWINGS

The accompanying drawings, which are incorporated in and constitute a part of the specification, illustrate embodiments of the invention and with the general description of the invention given above and the detailed description of the drawings given below, explain the principles of these inventions.

Figure 1:
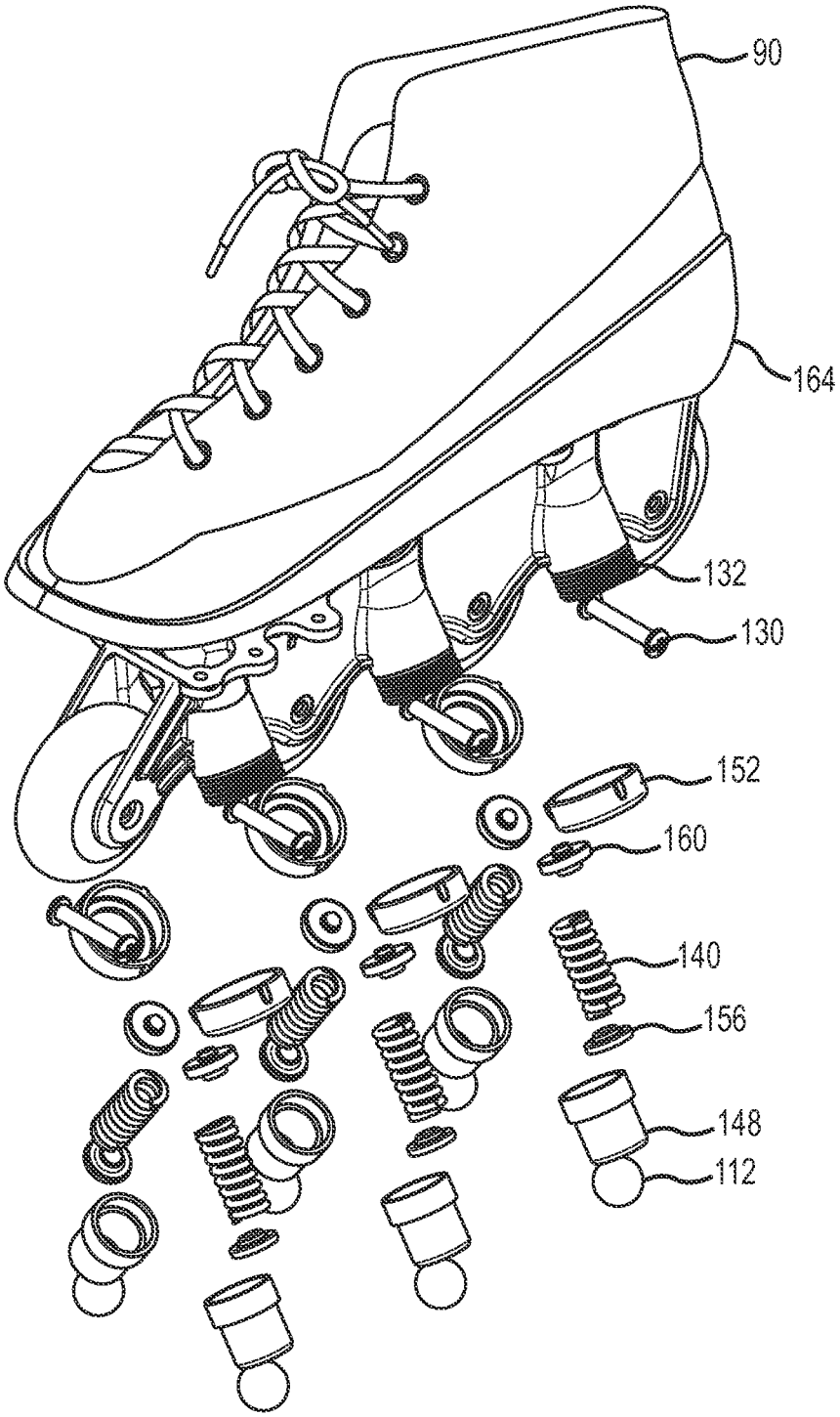
FIG. 1 is an isometric, exploded view of a braking device of one embodiment of the present invention.

To assist in the understanding of the embodiments of the present invention the following list of components and associated numbering found in the drawings is provided herein:

| No. | Component |
|---|---|
| 90 | Boot |
| 100 | Braking Device |
| 102 | Frame |

-continued

| No. | Component |
|---|---|
| 104 | First Wheel |
| 105 | Second Wheel |
| 106 | Third Wheel |
| 107 | Fourth Wheel |
| 108 | Slider |
| 112 | Ball |
| 114 | Base Opening |
| 116 | Spring Cap |
| 120 | Spring Cap Assembly |
| 124 | Cross Rib |
| 128 | Wheel Axle Aperture |
| 130 | Wheel Axle |
| 132 | Slider Receiver |
| 136 | Side Shield |
| 140 | Spring |
| 144 | Locator Disk |
| 148 | Sliding Collar |
| 152 | Retainer |
| 156 | Pad |
| 160 | Spring Spacer |
| 164 | Shield |
| 168 | Shield Width |
| 172 | Shield Height |
| 176 | Wheel-to-Wheel Length |
| 177 | Horizontal Extension |
| 178 | First Vertical Extension |
| 179 | Second Vertical Extension |
| 180 | Vertical Extension Thickness |
| 184 | Vertical Extension Gap |
| 188 | Horizontal Extension Thickness |
| 192 | Receiver Rib Thickness |
| 196 | Receiver Angle |
| 200 | Receiver Radius |
| 204 | Base Opening Length |
| 208 | Base Opening First Width |
| 212 | Horizontal Extension Width |
| 216 | Base Opening Radius |
| 220 | First Base Opening Distance |
| 224 | Second Base Opening Distance |
| 228 | Third Base Opening Distance |
| 232 | Horizontal Extension Length |
| 236 | Vertical Extension Radius |
| 240 | Vertical Extension Angle |
| 244 | First Radius Length |
| 248 | First Wheel Aperture Length |
| 252 | Second Wheel Aperture Length |
| 256 | Third Wheel Aperture Length |
| 260 | Fourth Wheel Aperture Length |
| 264 | Second Radius Length |
| 268 | Receiver Width |
| 272 | First Receiver Diameter |
| 276 | Second Receiver Diameter |
| 280 | Notch Height |
| 284 | First Receiver Radius |
| 288 | Receiver Rib Width |
| 292 | Third Receiver Diameter |

It should be understood that the drawings are not necessarily to scale. In certain instances, details that are not necessary for an understanding of the invention or that render other details difficult to perceive may have been omitted. It should be understood that the invention is not necessarily limited to the particular embodiments illustrated herein.

DETAILED DESCRIPTION

As described below, various embodiments of the present invention include a braking device 100 that provides a force used to generate braking friction. Embodiments of the present invention have significant benefits across a broad spectrum of endeavors. It is the Applicant's intent that this specification and the claims to be accorded a breadth in keeping with the scope and spirit of the described invention or inventions despite what might appear to be limiting language imposed by referring to specific disclosed examples.

FIG. 1 is an isometric view of one embodiment of the present invention where a boot 90 is interconnected to a shield 164, and various braking devices are shown in an exploded view. A user wears the boot 90 on his or her foot, and when a user tilts the boot 90 to either side, a friction-generating element or biasing device, a ball 112 in this embodiment, engages the surface to rotate the ball 112 and generate braking force. The braking devices in FIG. 1 comprise a slider receiver 132 disposed in the frame, a spring 140, a sliding collar 148, the ball 112, and a retainer 152. However, the embodiment in FIG. 1 also comprises a pad 156 and a spring spacer 160. The pad 156 provides a surface upon which the spring 140 can press against, and the pad 156 translates the spring force to the ball 112. As the ball 112 rotates against the pad, friction is generated that influences ball rotation which creates a braking friction between the ball and the surface that slows or stops longitudinal movement of the skate. The friction produced at the ball/pad interface is influenced by the spring stiffness, the pad material, the pad shape and configuration, the pad surface configuration, the ball material, the ball surface configuration, etc. Also, the pad may include an indent or pocket that receives the ball, which acts as a dynamic joint and increases contact between the ball and the pad. Accordingly, embodiments allow for the replacement of the ball, spring, and pad so that stopping characteristics can by selectively tailored to meet the user's needs. The spring spacer 160 is disposed in the slider receiver 132 and provides a surface upon which the spring 140 can press against.

FIG. 1 also shows other components of the present invention. A wheel axle 130 may be positioned in wheel axle apertures (shown in FIG. 6) to provide an axis upon which wheels may rotate. Further in this embodiment, a shield 164 interfaces with the top of the frame.

Figure 2B:
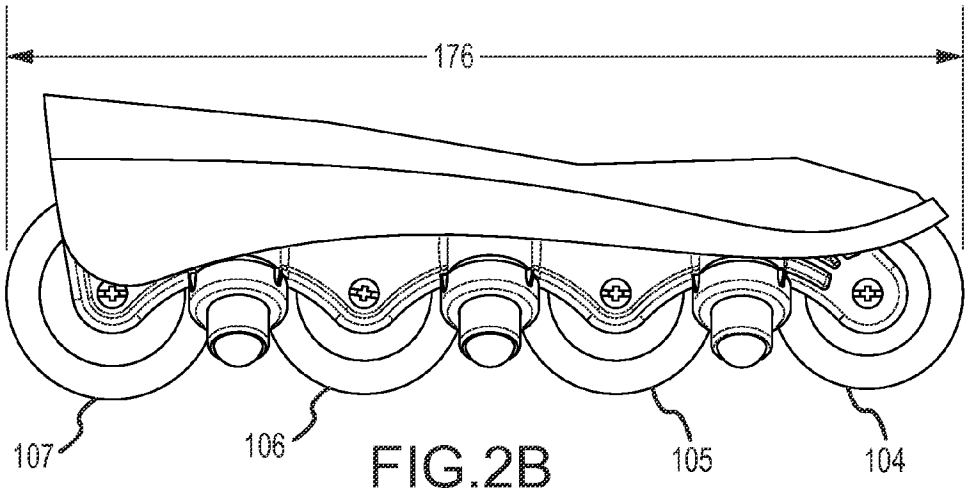
FIG. 2B is a side elevation view of the frame and shield of the embodiment in FIG. 2A.
Figure 2C:
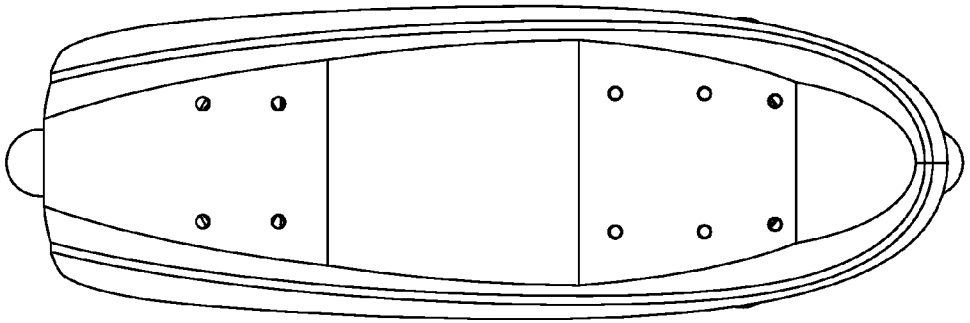
FIG. 2C is a top plan view of the frame and shield of the embodiment in FIG. 2A.
Figure 2A:
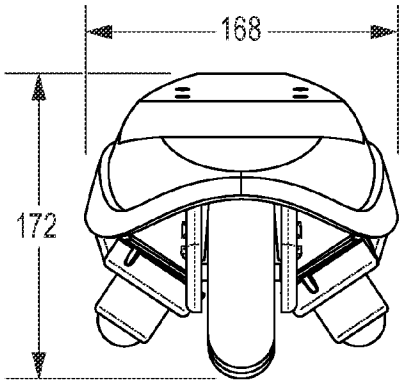
FIG. 2A is a front elevation view of a frame with a shield in accordance with embodiments of the present invention.

FIGS. 2A-2C show various views of the frame and the braking devices with the shield affixed to the frame. FIG. 2A is a front elevation view of the frame and shield assembly. The shield width 168 in this embodiment is approximately 4.6". Further, the shield height 172, or the distance between the bottom of the wheels and the top of the shield, is approximately 4.5". FIG. 2B shows a side elevation view of the frame and shield assembly, which comprises four wheels: a first wheel 104, a second wheel 105, a third wheel 106, and a fourth wheel 107. In this embodiment of the present invention, the first wheel 104 is approximately 72 mm in diameter, the second wheel 105 is approximately 76 mm in diameter, the third wheel 106 is approximately 76 mm in diameter, and the fourth wheel 107 is approximately 80 mm in diameter. These wheel sizes provide the user with a forward-leaning stance. One skilled in the art will appreciate other sequences of wheel sizes that are advantageous. For example, embodiments may have wheels that are the same size or that are larger towards the front end of the frame. FIG. 2C shows a top plan view of the shield and frame assembly.

Figure 3:
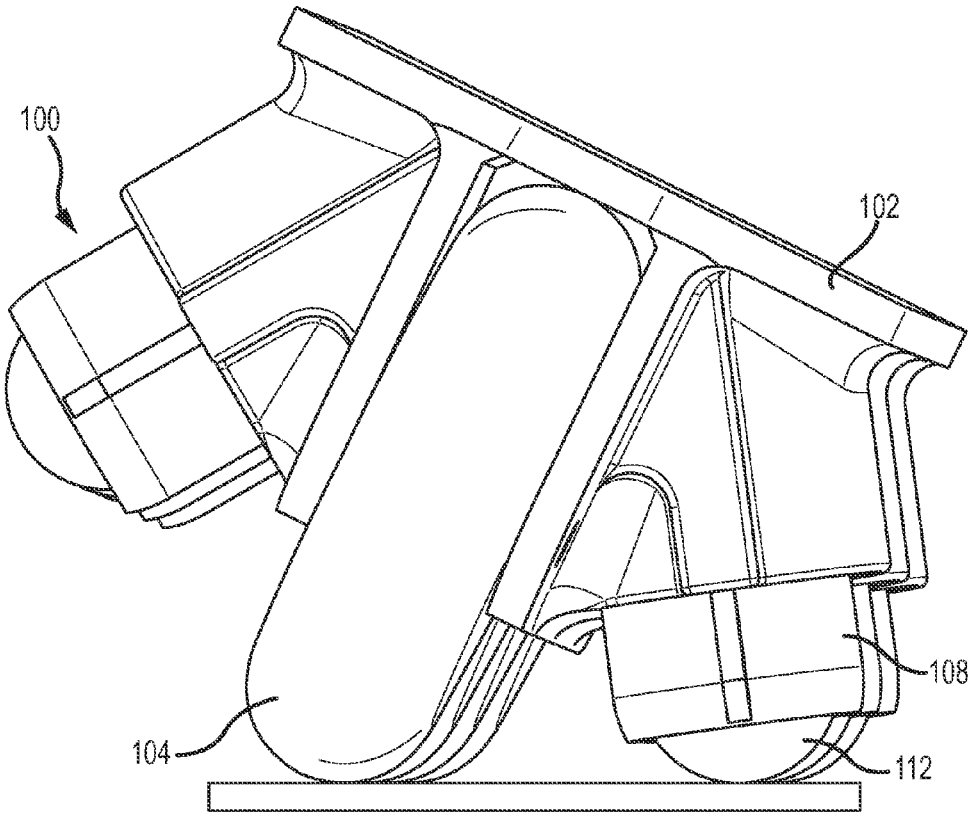
FIG. 3 is a front elevation view of a frame and braking device of one embodiment of the present invention.
Figure 4:
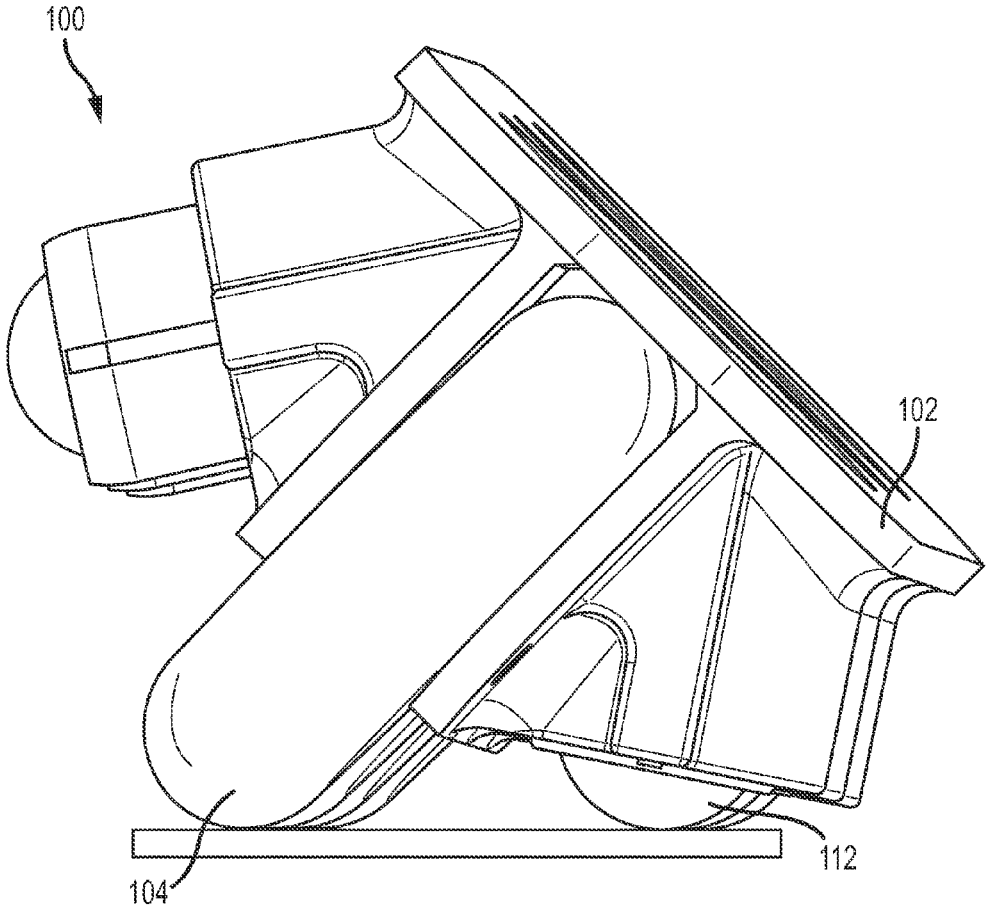
FIG. 4 is a front elevation view of the frame and braking device of FIG. 3 where a friction-generating element is biased into the frame.

FIGS. 3 and 4 show an embodiment of the present invention where braking devices 100 engage a surface to rotate a ball 112 and generate braking friction, which may be dependent on the amount of ball rotation. FIG. 3 shows the frame 102 tilted at from a vertical plane wherein a first wheel 104 is visible. A slider 108 is partially disposed in the frame 102, and the ball 112 is partially disposed in the slider 108. The slider 108 and the ball 112 extend outwardly at an angle relative to a plane through the longitudinal axis of the frame 102. The slider 108 and the ball 112 are forced outward by a spring. The braking device 100 in FIG. 3 is shown initially engaged because the ball 112 has just contacted the surface.

FIG. 4 shows the braking device 100 fully engaged. When the user tilts the frame 102 the ball 112 will initially contact with the ground. Further rotation will force the ball 112 upward into the frame 102, which will compress a spring positioned between the slider 108 and the frame 102. As the spring is compressed, the force exerted on the ball 112 will increase, thereby increasing the normal load imparted on the ground by the ball 112. As one skilled the art will appreciate, the greater the normal load, the greater the friction generated by the ball 112. Eventually, the slider 108 will be substantially positioned within the frame 102 wherein additional lateral rotation will increase the normal load to the ball 112 to affect maximum braking. When the frame 102 is rotated laterally in an opposite direction, force on the ball 112 and friction will decrease proportionately, which reduces the braking force. When the frame 102 is rotated a predetermined amount, the spring will expand and the ball 112 will be positioned away from the frame 102 and away from the ground.

In the embodiment depicted in FIGS. 3 and 4, the ball 112 may be 1" or 25 mm in diameter. However, one skilled in the art will appreciate embodiments of the present invention employ balls 112 of other sizes, and the balls 112 used in the same frame 100 do not have to be the same size. Further, in some embodiments, the ball 112 may freely rotate inside of the slider 108. In this instance, the ball 112 generates less braking force. In other embodiments of the present invention, the ball 112 may have a stifled or slowed rotation so the ball 112 generates a greater braking force. The ball 112 may generate different friction forces depending on various characteristics of the ball 112 such as, but not limited to, durometer hardness, other indicators of hardness, compressive strength, ductility, grain size, and crystalline structure.

FIGS. 3 and 4 show an embodiment of the present invention that has a slider 108 which is not confined to the braking device 100 with a separate retainer. Rather, the slider 108 comprises a flange disposed at a proximate end of the slider 108 that prevents the spring from pushing the slider 108 out of the braking device 100. Other embodiments, discussed in greater detail below, comprise a separate retainer that prevents the spring from pushing the slider 108 out of the braking device 100.

In further embodiments of the present invention, a slider 108 is not included. The distal end of the slider receiver portion of the frame 100 that houses the braking device may comprise an inwardly extending flange or an aperture such that a portion of the ball 112 is exposed through the flange or aperture to engage a surface. The spring pushes the ball 112 against the flange or aperture and function similar to other embodiments described herein.

Figure 5A:
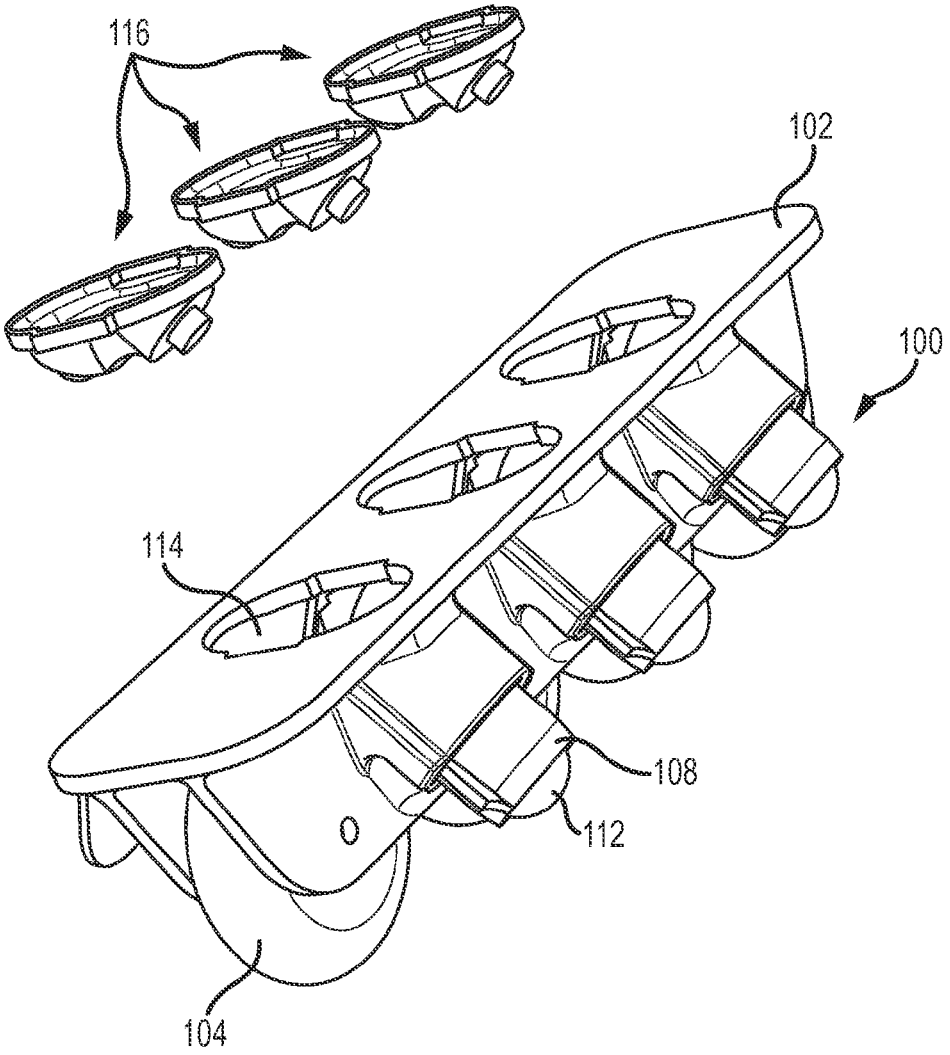
FIG. 5A is an isometric view of a frame and braking device with spring cap pairs.
Figure 5B:
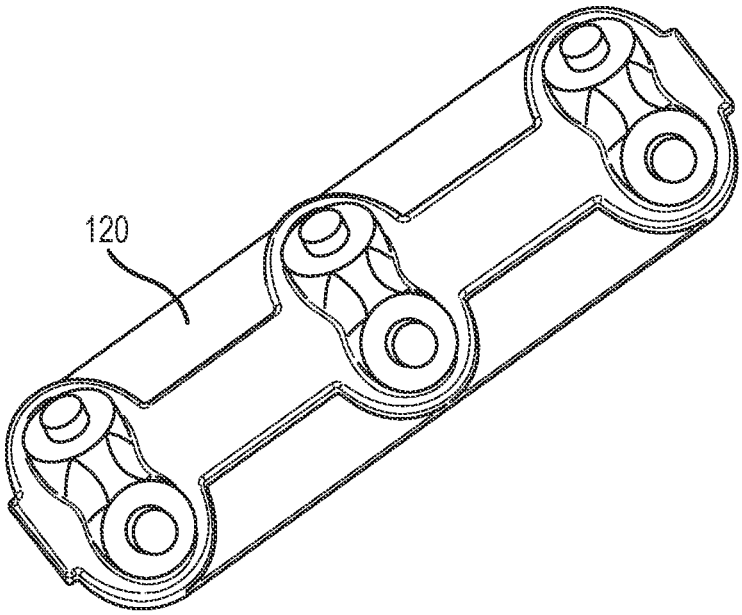
FIG. 5B is an isometric view of a spring cap assembly.

FIGS. 5A and 5B show the braking device 100 and three spring cap pairs 116 above the frame 102. This embodiment comprises a frame 102 and a series of braking devices 100 comprising of sliders 108 and balls 112. The three spring cap pairs 116 provide a location upon which a spring may press against. The base openings 114, which the spring cap pairs 116 are disposed, allow the frame 102 to mount into another device 100, typically an in-line boot. FIG. 5B shows a spring cap assembly 120 where the spring cap pairs 116 are configured into a single piece.

Figure 6:
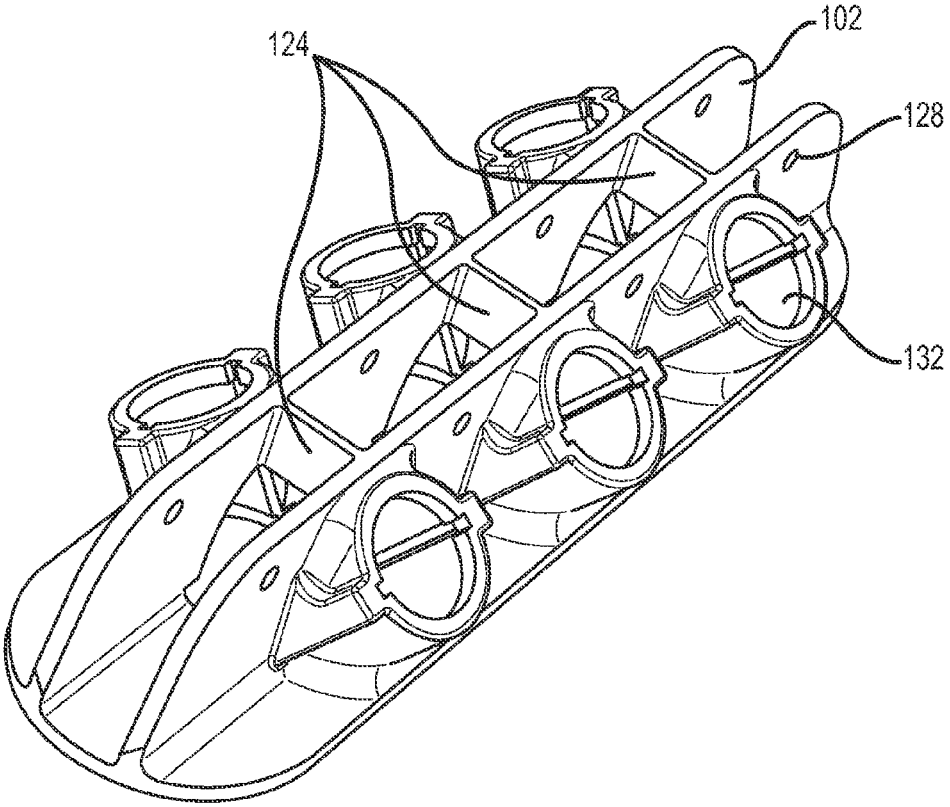
FIG. 6 is a bottom isometric view of a frame of one embodiment of the present invention.

FIG. 6 shows a bottom isometric view of an embodiment of the present invention. Here, six slider receivers 132 disposed on the frame 102, with three slider receivers 132 disposed on one side of the frame 102, and three slider receivers 132 disposed on the opposite side of the frame 102. The two arrays of slider receivers 132 may exhibit bilateral symmetry about a plane through the longitudinal axis of, and perpendicular to the top surface of, the frame 102. Cross ribs 124 are disposed between the slider receivers 132 to add rigidity to the frame 102.

Also shown in FIG. 6 are a series of wheel axle apertures 128 where wheels and wheel axles may be located. The wheel axle apertures 128 are spaced along the longitudinal length of the frame 102 such that the slider receivers 132 may be disposed between each wheel axle aperture 128.

In the embodiment shown in FIG. 6, the frame 102 is made from cast aluminum which is light weight and strong. However, other materials may be used, such as, but not limited to, carbon fiber, pressed aluminum, polyurethane, or magnesium.

Figure 7:
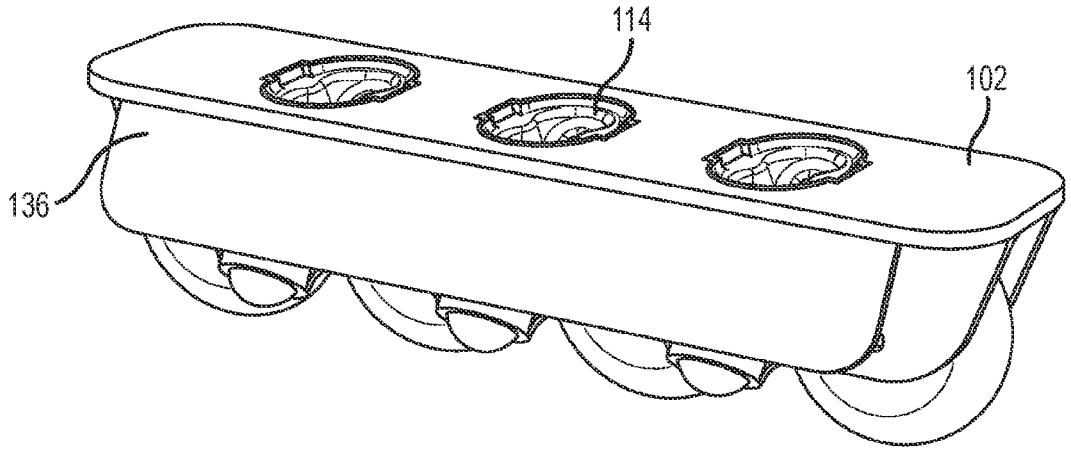
FIG. 7 is an isometric view of a frame with a side shield in accordance with some embodiments of the present invention.

FIG. 7 shows another embodiment of the present invention that comprises a side shield 136 that extends from the top of the frame 102 towards the braking device balls. The side shield 136 acts as a governor when the user tilts the frame 102 and engages the braking device on a surface. As the balls are pressed into the frame 102, the shield will stop the travel of the balls at a certain point during operation of the braking device. This governing of the braking device prevents the ball and slider assemblies from locking up and damaging the braking device. As such, the side shield 136 may be made of a friction producing material. The side shield 136 may also be compliant so not to damage the playing surface when contact is made. Further, the side shield 136 provides protection so pucks or balls impacting the skate do not damage the braking devices. In addition, the side shield 136 prevents entanglement between the braking devices of the user's left and right skates as well as between the user's skates and a third party's skates. The side shields 136 may be removable.

Figure 8A:
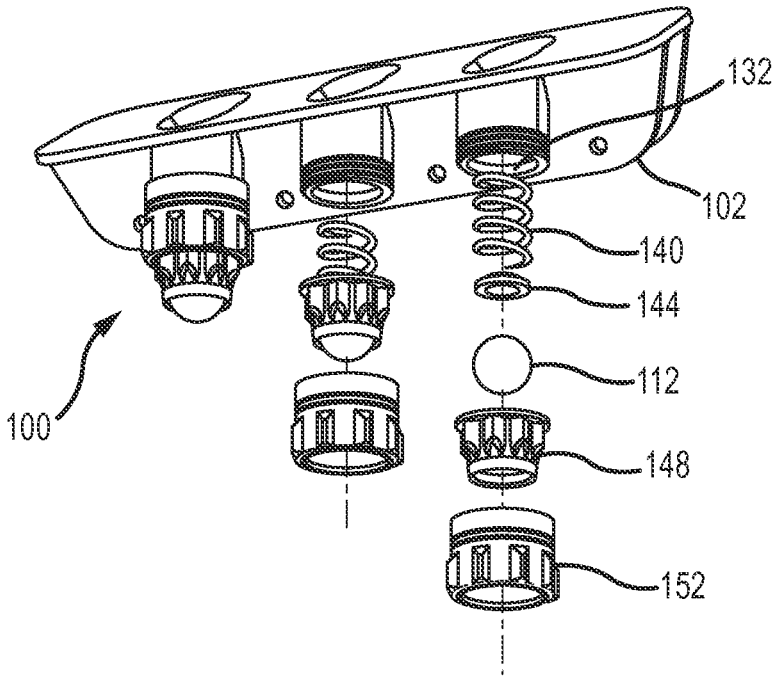
FIG. 8A is an isometric, exploded view of a braking device of one embodiment of the present invention.
Figure 8B:
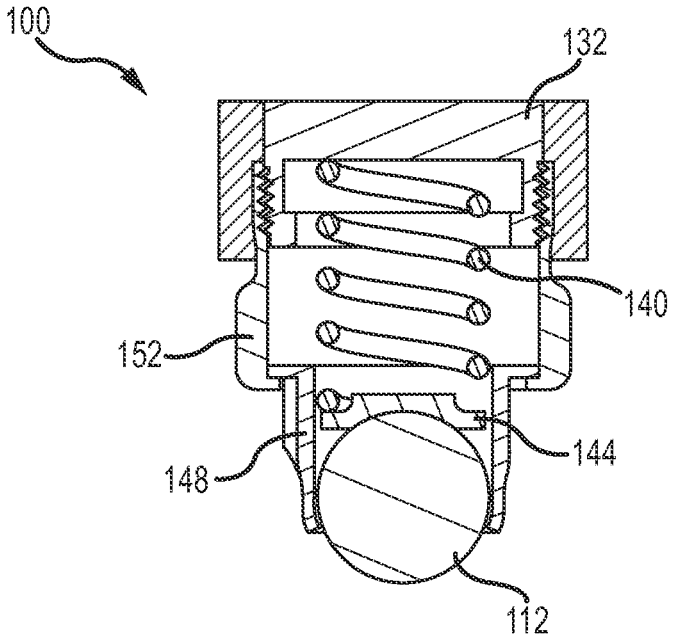
FIG. 8B is a cross-sectional view of a braking device of one embodiment of the present invention.

FIGS. 8A and 8B show a retainer 152 used to secure the sliding collar 148 and prevent the spring 140 from pushing the sliding collar 148 out of the braking device 100. The frame 102 accommodates a slider receiver 132, which is an opening or cavity that houses components of the braking device 100. A spring 140 is partially disposed in the slider receiver 132. The spring 140 size and stiffness may be altered to suit player needs or desires. The springs may also be different where the braking devices provide different braking characteristics. As the ball 112 is pressed into the frame 102, specifically the slider receiver 132, the spring 140 compresses and provides an increasing force against a locator disk 144, and in turn, an increasing force against the ball 112. The locater disk 144 helps the spring 140 align with the ball 112 and allows the ball 112 to rotate, or not rotate, as the braking device 100 is engaged.

More specifically, the frictional interaction between the ball 112 and the locater disk 144 may dictate the braking force of the braking device. The locator disk 144 comprises an indentation to provide more surface area contact with the ball 112. The locator disk 144 can be made from a variety of materials with a number of features that determine the friction generated between the locator disk 144 and the ball 112. For example, the locator disk 144 may comprise a textured or coarse surface that generates a high amount of frictional force with the ball 112. A user may desire to change the locator disk 144 and/or ball 112 to set up different performance characteristics of the braking device 100.

The sliding collar 148 and the retainer 152 are disposed on the end of the braking device 100. The sliding collar 148 comprises an aperture on its bottom edge or distal surface, teeth on its outer surface, and a flange on its top edge or proximate surface. The aperture allows the ball 112 to extend out from the braking device 100, but the aperture does not allow the ball 112 to fall out. This means the diameter of the aperture is less than or equal to the diameter of the ball 112. The teeth on out the outer surface of the sliding collar 148 correspond to teeth on the retainer 152 which prevents rotation of the sliding collar 148 as the user engages the braking device 100. The flange on the proximate surface of the sliding collar 148 extends outward in the radial direction to provide a surface upon which the retainer 152 can secure the sliding collar 148.

The retainer 152 comprises teeth on its inner diameter, threads on its outer surface, and an inward facing flange located proximate the teeth on the inner surface. The teeth correspond to the teeth on the outer surface of the sliding collar 148 which prevents rotation of the sliding collar 148 when a user engages the braking device 100. The inward facing flange of the retainer 152 is also located towards the same distal end of the retainer 152 as the teeth. The inward facing flange corresponds to the flange of the sliding collar 148 such that the inner diameter of the inward facing flange is equal to or less than the outer diameter of the flange of the sliding collar 148. This allows the two flanges to selectively engage such that the retainer 152 secures the sliding collar 148 to prevent the danger of the sliding collar 148 falling out of the braking device 100. The retainer 152 also comprises threads on its inner surface that correspond to threads on the outer surface of the slider receiver 132 such that the retainer 152 is threaded onto the slider receiver 132 and the frame 102.

FIG. 8B shows a cross-sectional view of an assembled braking device 100. The retainer 152 screws into the slider receiver 132 on the frame 102 such that the other components of the braking device 100 are secured. The flange on the proximate surface of the sliding collar 148 interfaces with the inward facing flange of the retainer 152, and the ball 112 interfaces with the sliding collar's 148 aperture. One end of the spring 140 presses against a base of the slider receiver 132 or a spring cap, and the other end of the spring 140 presses against the locator disk 144, which presses against the ball 112. The ball presses against the sliding collar 148 which causes the flanges of the sliding collar 148 and the retainer 152 to interface.

Embodiments of the present invention may include adjustable components or features. For example, in FIGS. 8A and 8B the distance that the sliding collar 148 extends outward from the frame 102 may be adjusted. The flange on the proximate surface of the sliding collar 148 governs the maximum distance that the sliding collar 148 may extend outward. A user can alter the distance by altering the interface between the sliding collar's 148 flange and the inward facing flange of the retainer 152. A user may insert an object between the flanges to move the sliding collar 148 further into the frame 102. Objects such as washers, o-rings, or other similar objects may be utilized to adjust the distance that the sliding collar 148 extends outward from the frame 102.

A more straightforward adjustment of the braking device 100 is the substitution of the spring 140 for another spring 140. The replacement spring 140 may have different properties such as stiffness. Further, the scope of the present invention is not limited to springs 140. In some embodiments air cushions, leaf springs, hydraulics, or magnetic repulsion may be used to providing a dampening effect between the ball 112 and the frame 102. Further yet, embodiments of the present invention are not limited to the linear force equation of the spring 140:

$$F=k(x_2-x_1)$$

where F is the force generated by the compression of the spring, k is the stiffness constant of the spring, $x_2$ is the final position of the spring, and $x_1$ is the initial position of the spring. Other embodiments may comprise features that exhibit non-linear responses to various inputs. In some embodiments, this may mean that the initial input results in little response, but after a threshold input the resulting response greatly increases, similar to an ice skater or snowboarder using an edge to turn.

The embodiment depicted in FIGS. 8A and 8B comprise a retainer 152 selectively interconnected to the slider receiver 132. In this embodiment, the selective interconnection is a threaded connection where a user screws the retainer 152 onto the slider receiver 132. One skilled in the art will appreciate other means of selective interconnection. The retainer 152 allows a user to quickly disassemble the braking device 100 and change out worn parts or upgrade with improved parts.

Figure 9A:
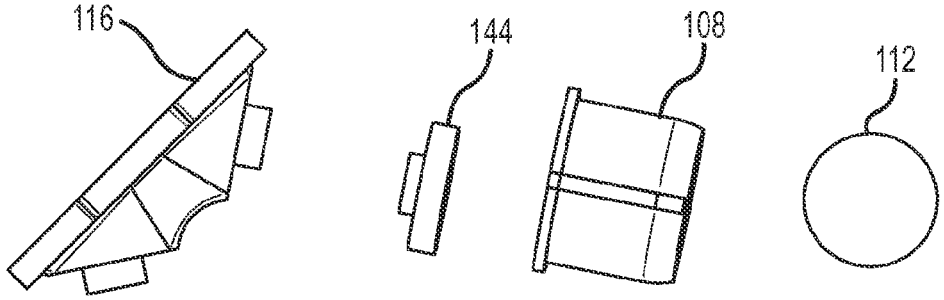
FIG. 9A is a side elevation view components of a braking device of one embodiment of the present invention.
Figure 9B:
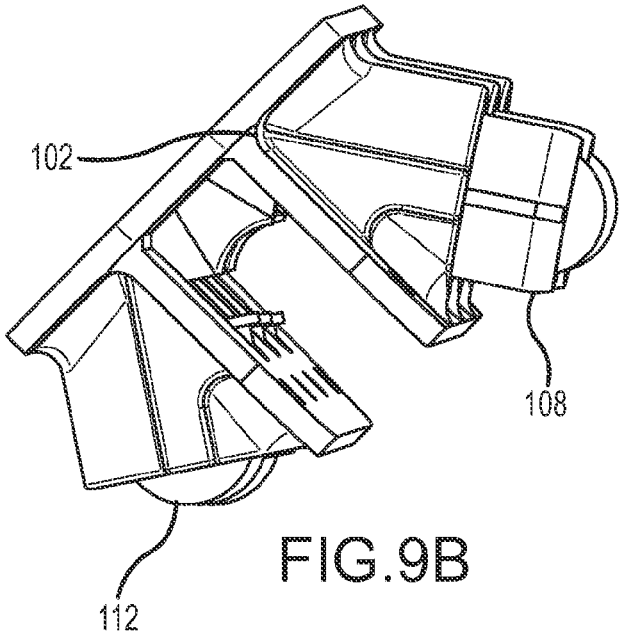
FIG. 9B is a side isometric view of a frame with the braking device components of the embodiment in FIG. 9A.
Figure 9C:
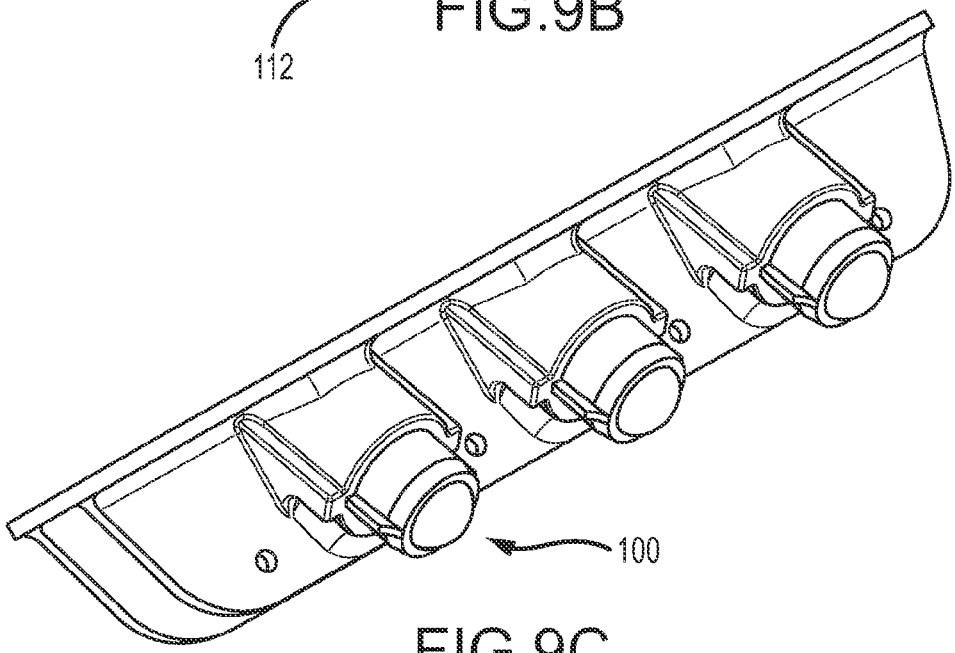
FIG. 9C is an isometric view of the frame and braking device of the embodiment in FIG. 9B.

FIGS. 9A-9C show various views of the frame 102 and braking device 100. FIG. 9A shows the spring cap 116, the locator disk 144, the slider 108, and the ball 112 in an exploded view. Also shown in FIG. 9A are two ribs on the outer diameter of the slider 108, one rib disposed toward the leading edge of the frame 102 and one rib disposed towards the trailing edge of the frame 102. These ribs correspond to notches in the slider receivers in the frame 102 such that the sliders do not rotate when the user engages the braking device 100. The top edge of the slider 108 has a flange that extends outward. This flange governs the extent to which a spring can press the ball 112 and the slider 108 outward from the frame 102. When a user inserts the slider 108 through a base opening on top of the frame 102, the slider 108 passes through the slider receiver, and the slider 108 extends outward from the frame 102. However, the flange catches the inner surface of the slider receiver, and the slider 108 cannot extend all the way through the slider receiver. This allows the braking device 100 to function without a retainer as described elsewhere herein. FIG. 9B shows the embodiment in FIG. 9A where the components are assembled into a frame 102 and a braking device 100. FIG. 9C shows an isometric view of a frame 102 and three braking devices 100 with the rib-notch configuration described above.

Although a generic ball 112 is used as an example of a friction-generating device in FIGS. 9A-9C, the ball 112 may be configured to interact with a variety of surfaces and conditions. For example, when embodiments of the present invention are used on a sport court, the ball 112 may be a compliant and made from the same or similar material as the wheel or court, which includes, but is not limited to, polyurethane, hard rubber, copolymer plastic, aluminum, carbon fiber, and titanium. On less forgiving surfaces such as asphalt and concrete the ball 112 may be made from a stiffer material to prevent ball deformation. Further, the ball 112 may be dimpled, created by a bead-blasting technique, for example. Surface features that add texture to the ball 112 can extend its useful life within embodiments of the present invention.

Even further, other embodiments of the present invention do not utilize a ball 112 as a friction-generating device. Other embodiments utilize a bar that has a longitudinal axis disposed substantially parallel to the longitudinal axis of the slider receiver. Further embodiments may utilize different orientations of the bar or other friction-generating device including, but not limited to, disks, blades, wheels, rectangular prisms, and plates.

One skilled in the art will appreciate the ball 112, or friction-generating device, is not the only component that may provide the braking force against a surface. Other components of the braking device 100 such as the slider 108 may contact the ground and generate braking friction. This may prove advantageous because a greater surface area contacts the ground and provides additional friction and braking force. There is also advantage in the multi-stage aspect of the slider 108 contacting the ground. As the ball 112 contacts the surface a certain amount of braking force exists, but as the slider 108 contacts the surface there is a jump in braking force. This may be akin to ice skates cutting into the ice with an edge of the skate's blade. Further embodiments of this concept are not limited to the slider 108, and other embodiments may comprise several components that progressively contact the surface as a user engages the braking device 100, much like a telescoping device. One skilled in the art will appreciate various combinations of components that contact the ground at different stages of braking device 100 engagement to provide a braking force response that may be linear, non-linear, or otherwise.

FIGS. 9A-9C show three braking devices 100 disposed on each side of the frame 102. Other embodiments of the present invention may have different combinations and configurations of braking devices 100. A side of the frame 102 may have fewer or greater braking devices 100 than three or even no braking devices 100 at all. In an asymmetric configuration, one side of the frame 102 has one or more braking devices 100, and the opposite side has no braking devices 100. This configuration may be advantageous because it's more economical and simpler than other configurations, and the single braking device 100 may be sufficient for the user's purposes.

Similarly, the braking devices 100 themselves need not be identical. In one embodiment, the center braking device 100 could comprise a larger ball 112 or a ball 112 that extends further from the frame 102. This configuration would allow the center braking device 100 to contact a surface first and provide an initial braking force. As the user continues to tilt the frame 102, the other two braking devices 100 may contact the surface and provide additional braking force. One skilled in the art will appreciate various symmetrical and asymmetrical combinations of the braking devices 100 to achieve various advantages.

Figure 10B:
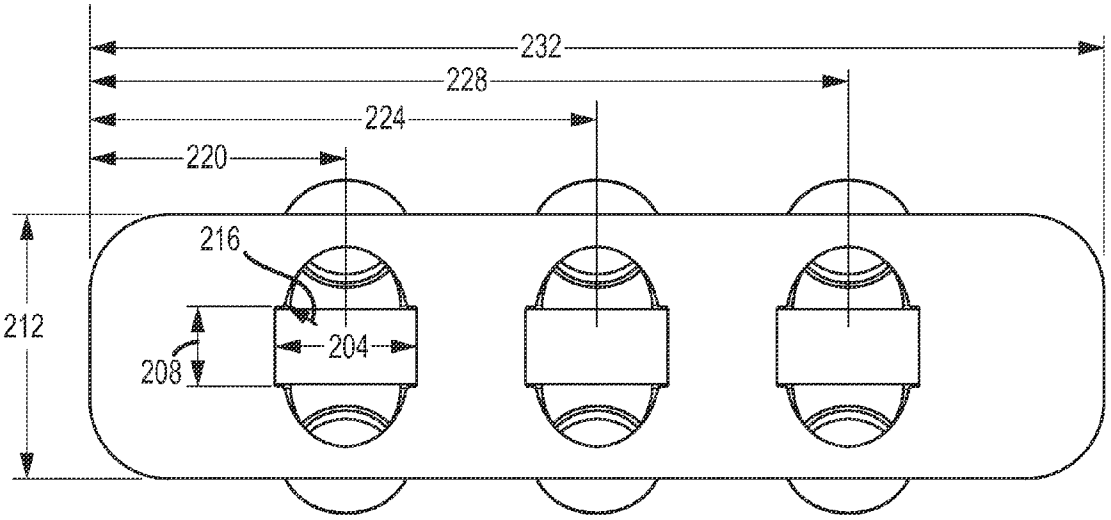
FIG. 10B is a top plan view of the frame of the embodiment in FIG. 10A.
Figure 10C:
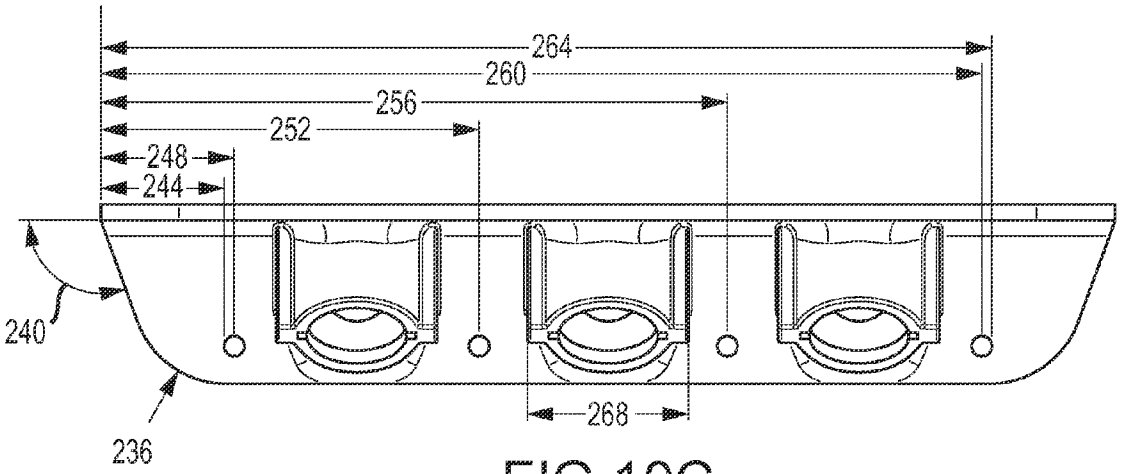
FIG. 10C is a side elevation view of the frame of the embodiment in FIG. 10 A.
Figure 10A:
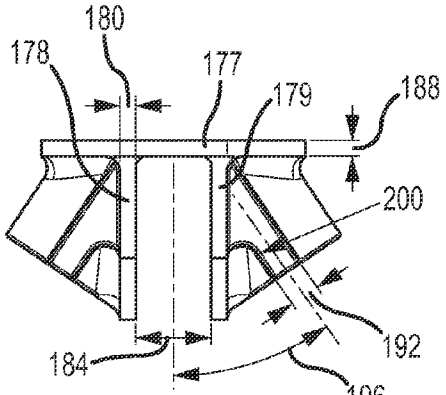
FIG. 10A is a front elevation view of a frame of one embodiment of the present invention.

FIGS. 10A-10C show various views of a frame 102 according to an embodiment of the present invention. FIG. 10A shows a front elevation view of the frame 102. The frame 102 is generally comprised of a horizontal extension 177 and first and second vertical extensions 178, 179 that descend below the horizontal extension 177. In this embodiment, the first and second vertical extensions 178, 179 are substantially parallel to each other and substantially perpendicular to the horizontal extension 177. One skilled in the art will appreciate other configurations and orientations of extensions. The vertical extension thickness 180 is approximately 5 mm. In this embodiment, there is bilateral symmetry about a vertical plane through the longitudinal axis of the frame 102, and thus both vertical extensions 178, 179 have the same thickness in this embodiment. There is also a gap between the two vertical extensions 178, 179 where wheels of an in-line skate may be disposed. This vertical extension gap 184 is approximately 24 mm. Also, the horizontal extension 177 from which the two vertical extensions 178, 179 descend has a horizontal extension thickness 188 of approximately 5 mm.

The embodiment in FIGS. 10A-10C has slider receivers disposed on either side of the frame 102. These slider receivers are generally cylindrical in shape, but in this embodiment ribs run along opposite sides of the slider receivers to reinforce the slider receivers and provide a notch on the inner surface of the slider receivers. When viewed from FIG. 10A, the receiver rib thickness 192 is approximately 9.63 mm. Further, the lower sides of the receiver ribs 192 blend into the vertical extensions 178, 179 at a radius. The receiver radius 200 in this embodiment is approximately 5 mm. In addition, the slider receivers are oriented at an angle from a vertical plane traveling through the longitudinal axis of the frame 102. The receiver angle 196 in this embodiment is approximately 33.75 degrees.

Other embodiments of the present invention may include a system to adjust the receiver angle 196 to an angle other than 33.75 degrees. The braking devices 100 arrayed on either side could be compartmentalized and discrete from the frame 102. Such a braking device system could be affixed to a longitudinal axis on either side of the frame 102 where the braking device system could be adjusted to alter the receiver angle 196. In some embodiments the receiver angle 196 is between approximately 0 and 90 degrees. In preferred embodiments of the present invention, the receiver angle 196 is between approximately 15 and 50 degrees. In a most preferred embodiment, the receiver angle 196 is approximately 33.75 degrees.

FIG. 10B shows a top plane view of the frame 102 in FIG. 10A. From this perspective, there are base openings disposed over the slider receivers. These base openings provide a location to dispose spring caps from which springs may press against. Also, these base openings are where another device 100, such as an in-line boot, may interconnect with the frame 102. The base openings in this embodiment are generally ovoid with a rectangular section disposed at the center of the base openings. The base opening length 204 is the length of the rectangular portion measured along the longitudinal axis of the frame 102. The base opening length 204 in this embodiment is approximately 45.35 mm.

The base opening first width 208 is the width of the rectangular potion measured in the lateral direction, and the base opening first width is approximately 25.45 mm in this embodiment of the invention. The transition between the rectangular portion of the base opening 114 and the ovoid portion of the base opening 114 is not necessarily abrupt. Rather, the transition may be radiused. The base opening radius 216 in this embodiment is approximately 1 mm. In addition, the base horizontal extension width 212 in this embodiment is approximately 84 mm.

As mentioned above, the embodiment of the present invention depicted in FIGS. 10A-10C exhibits bilateral symmetry, and thus the base openings 114 are laterally centered on the horizontal extension 177 shown in FIG. 10B. The longitudinal location of each base opening 114 can be expressed in terms of distance from the leading edge of the horizontal extension 177 to the center of the base opening 114. The first base opening distance 220 is approximately 81.5 mm, the second base opening distance 224 is approximately 161.5 mm, and the third base opening distance 228 is approximately 241.5 mm. The horizontal extension length 232 is approximately 323 mm. Therefore, in this embodiment, the frame 102 is also symmetric about a lateral plane that extends through the center of the middle base opening. One skilled in the art will appreciate braking device location other than the symmetric ones described above. For example, it may be advantageous to group braking devices towards the leading edge or the trailing edge of the frame 102.

FIG. 10C shows a side elevation view of the embodiments shown in FIGS. 10A and 10B. From this perspective, the vertical extensions 178, 179 are not a rectangle. Rather, the vertical extensions 178, 179 taper inward from the leading edge (and the trailing edge) at a vertical extension angle 240, which is approximately 110 degrees in this embodiment. As the tapering edge approaches the bottom edge of the vertical extensions 178, 179, the tapering edge curves inward at a vertical extension radius 236 to provide a smooth transition. The vertical extension radius 236 is approximately 30 mm. Further, the vertical extension radius 236 is curved about a single point on the vertical extensions 178, 179. The horizontal distance between this point and the leading edge of the frame 102 is the first radius length 244, which is approximately 39.93 mm in this embodiment. Likewise, the horizontal distance between the point about which the trailing edge radius is curved and the leading edge is the second radius length 265, which is approximately 283.07 mm in this embodiment of the present invention.

Also shown in FIG. 10C are the various wheel axle apertures where the axles from wheel assemblies may be disposed. Similar to the base openings above, the longitudinal position of the wheel axle apertures can be measured from the leading edge of the frame 102 to the center of the wheel axle apertures. The first wheel aperture length 248 is approximately 42.5 mm, the second wheel apertures length 252 is approximately 120.5 mm, the third wheel aperture length 256 is approximately 199.5 mm, and the fourth wheel aperture length 260 is approximately 280.5 mm. In addition, the width of the receiver from rib to rib is shown in FIG. 10C. In this embodiment, the receiver width 268 is approximately 51.35 mm.

Figure 11A:
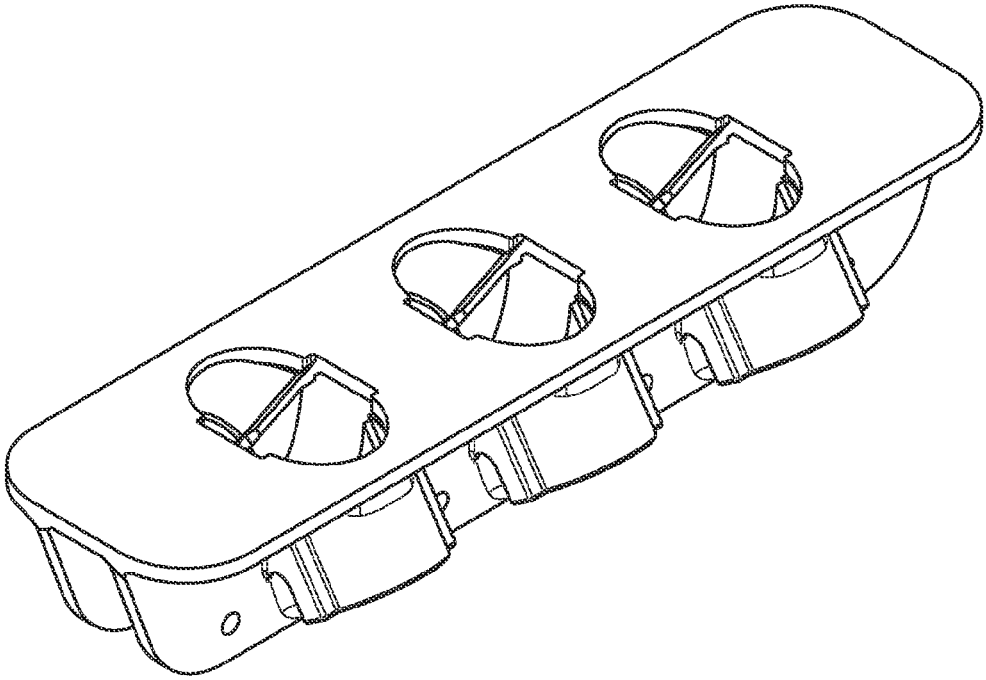
FIG. 11A is an isometric view of the frame of the embodiment in FIG. 10A.
Figure 11B:
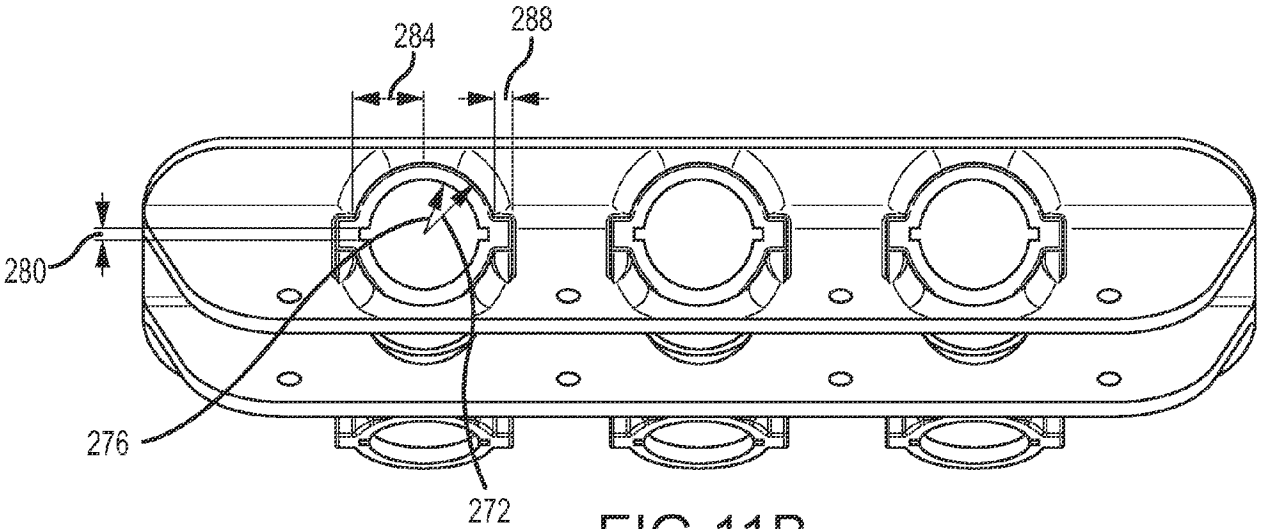
FIG. 11B is a side view of the frame of the embodiment in FIG. 10A.
Figure 11C:
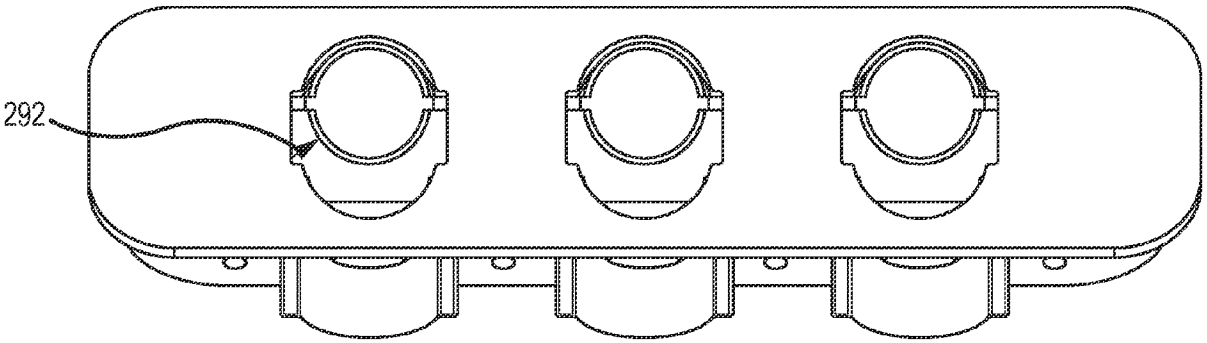
FIG. 11C is a top view of the frame of the embodiment in FIG. 10A.

FIGS. 11A-11C show alternative isometric and elevation views of the embodiment in FIGS. 10A-10C. FIG. 11A shows an isometric view of the frame 102 and corresponding slider receivers. FIG. 11B shows a type of elevation view of the frame 102 that is aligned with the longitudinal axis of the slider receivers. In other words, the frame 102 is tilted at 33.75 degrees to look straight down the slider receivers. The slider receivers have two different diameters when viewed from this perspective. The first receiver diameter 272 is approximately 41.36 mm, and the second receiver diameter 276 is approximately 31.88 mm. The transition between the smaller diameter and the larger diameter of the second receiver diameter 276 may provide a surface upon which a spring may press against. Further, there are two notches in the second receiver diameter 276. These notches are on opposite sides of the second receiver diameter 276 with one disposed towards the leading edge of the frame 102 and one disposed towards the trailing edge of the frame 102. The notch height 280 is approximately 3.63 mm. The distance between the outermost edge of the notch and the center of the slider receiver is the first receiver radius 284, which is approximately 8.68 mm. The distance between the outermost edge of the notch and the outermost edge of the receiver rib is the receiver rib width 288, which is approximately 7.07 mm.

FIG. 11C shows another perspective of the frame 102 from FIGS. 11A and 11B, but this perspective is the opposite of that in FIG. 11B. In other words, the perspective in FIG. 11C is a top plane view of the frame 102 that has been tipped at 33.75 degrees. From this vantage, one can see the third receiver diameter 292, which in this embodiment is the same as the first receiver diameter 272 of 41.36 mm.

For exemplary purposes only, most embodiments of the present invention described herein have been directed toward in-line skates. However, the present invention should not be limited to only in-line skates. The present invention is applicable to any device that may benefit from present invention and the braking devices described herein. For example, embodiments of the present invention may be utilized on bicycles, ice skates, or motorcycles.

Similarly, most embodiments of the present invention described herein have been directed toward stand-alone in-line skates with braking devices already incorporated into the frame of the in-line skates. In other embodiments of the present invention, the braking device, or combination of braking devices, may be adapted for use on existing in-line skates that do not have slider receivers or other braking device components integrated into the frame.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about" or "approximately."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the present invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the present invention. The embodiments described herein above are further intended to explain best modes of practicing the invention and to enable others skilled in the art to utilize the invention in such a manner, or include other embodiments with various modifications as required by the particular application(s) or use(s) of the present invention. Thus, it is intended that the claims be construed to include alternative embodiments to the extent permitted by the prior art.

What is claimed is:

1. An in-line skate assembly, comprising:

a frame having a plurality of receivers each having a proximate end and a distal end;

a spring cap positioned in each of said plurality of receivers at said proximate end of each receiver;

a sliding collar positioned in each of said plurality of receivers, wherein an outwardly extending flange is disposed on a proximate surface on each of said sliding collars, and wherein a distal surface on each of said sliding collars includes an aperture;

a ball positioned in each of said sliding collars, wherein at least a portion of said ball is exposed through said aperture on each of said sliding collars;

a locator disk positioned within each of said sliding collars and located on a side of said ball opposite said aperture on each of said sliding collars;

a spring positioned in each of said plurality of receivers, said spring having a first end and a second end, wherein said first end of said spring interfaces with each said spring cap, wherein said spring extends into said sliding collar, and wherein said second end of said spring interfaces with said locator disk such that said spring exerts a force on said locator disk, which in turn exerts a frictional force on said ball, which biases a portion said ball against said distal surface of said sliding collar;

a retainer with an inwardly extending flange on a distal surface of said retainer, wherein said retainer operatively interconnects to each of said plurality of receivers;

wherein each of said sliding collars has a first position of use wherein said inwardly extending flange of said retainer is selectively engaged with said outward extending flange of said sliding collar; and wherein each of said sliding collars has a second position of use wherein said ball is in contact with a surface and said ball is forced into each of said plurality of receivers.

2. The assembly of claim 1, wherein said plurality of receivers is six receivers, and wherein three receivers are disposed on a first side of said frame, and three receivers are disposed on a second side of said frame, wherein said first side and second side of said frame are substantially parallel.

3. The assembly of claim 1, further comprising:

a shield selectively interconnected to said frame, said shield having a substantially planar shape extending substantially coplanar with at least one longitudinal axis of said plurality of receivers, and said shield disposed proximate at least one of said plurality of receivers, wherein said shield generally protects at least one of said plurality of receivers against lateral interference.

4. The assembly of claim 1, wherein said locator disk comprises an indention that corresponds to said ball to provide greater surface area contact between said locator disk and said ball, wherein when said ball engages a surface and said ball rotates, a frictional force is generated between said locator disk and said ball.

5. The assembly of claim 1, said frame comprising:

a horizontal extension having a top surface and a bottom surface;

a first vertical extension descending from said bottom surface of said horizontal extension, and a second vertical extension descending from said bottom surface of said horizontal extension;

wherein said first vertical extension is substantially parallel to said second vertical extension, wherein said first vertical extension has a first outer surface that faces away from said second vertical extension, and wherein said first and second vertical extensions are substantially perpendicular to said horizontal extension; and wherein said plurality of receivers are at least partially disposed on said first outer surface.

6. The assembly of claim 5, wherein said first vertical extension comprises a first aperture, and said second vertical extension comprises a second aperture, wherein a wheel axle is disposed in said first and second apertures, and a wheel is disposed about said wheel axle, and said wheel is at least partially disposed between first and second vertical extensions.

7. The assembly of claim 5, wherein said plurality of receivers is disposed at an angle relative to said first vertical extension.

8. The assembly of claim 7, wherein said angle is approximately 33.75 degrees.

9. An in-line skate assembly, comprising:

a frame having a plurality of receivers having a proximate end and a distal end, said distal end of each of said plurality of receivers having an inwardly facing flange that forms an aperture;

a friction-generating means disposed in each of said plurality of receivers at said distal end of said receivers, wherein at least a portion of said friction-generating means is exposed through said aperture of said inwardly facing flange of each of said plurality of receivers; and a biasing means disposed between said proximate end of each of said plurality of receivers and said friction-generating means of each of said plurality of receivers, wherein said biasing means communicates with said friction-generating means and produces a continuous force against said friction-generating means of each of said plurality of receivers.

10. The assembly of claim 9, further comprising a plurality of friction-generating disks disposed between said each of said biasing means and said friction-generating means, wherein engagement of one of said friction-generating means causes said biasing means associated with the engaged friction-generating means to generate a force against said friction-generating disk, wherein friction generated between said engaged friction-generating means and friction-generating disk slows longitudinal movement of said frame.

11. The assembly of claim 9, further comprising a protection means disposed relative to said plurality of receivers.

12. The assembly of claim 9, further comprising a retaining means disposed on said distal end of each of said plurality of receivers, said retaining means secures said friction-generating means in each of said plurality of receivers, wherein said retaining means allows said friction-generating means to pass through said retaining means to engage a surface.

13. An in-line skate assembly, comprising:

a frame having a plurality of receivers each having a proximate end and a distal end;

a sliding collar positioned in each of said plurality of receivers, wherein an outwardly extending flange is disposed on a proximate surface on each of said sliding collars, and wherein a distal surface on each of said sliding collars includes an aperture;

a ball positioned in each of said sliding collars, wherein at least a portion of said ball is exposed through said aperture on each of said sliding collars;

a spring positioned in each of said plurality of receivers, said spring having a first end and a second end, wherein said first end of said spring communicates with each said ball, wherein said spring extends into said sliding collar, and wherein said spring exerts a force on said ball, which biases a portion said ball against said distal surface of said sliding collar; and a retainer with an inwardly extending flange on a distal surface of said retainer, wherein said retainer operatively interconnects to each of said plurality of receivers, said inwardly extending flange selectively engages said outward extending flange of said sliding collar.

14. The assembly of claim 13, wherein said plurality of receivers is six receivers, and wherein three receivers are disposed on a first side of said frame, and three receivers are disposed on a second side of said frame, wherein said first side and second side of said frame are substantially parallel.

* * * * *